United States Patent [19]

Takechi et al.

[11] 3,947,293

[45] Mar. 30, 1976

[54] METHOD FOR PRODUCING HIGH-STRENGTH COLD ROLLED STEEL SHEET

[75] Inventors: Hiroshi Takechi; Koji Ozaki; Kazuo Namba, all of Kisarazu; Kunihiko Komiya, Kimitsu, all of Japan

[73] Assignee: Nippon Steel Corporation, Japan

[22] Filed: Dec. 5, 1974

[21] Appl. No.: 529,831

Related U.S. Application Data

[63] Continuation-in-part of Ser. No. 432,205, Jan. 10, 1974, abandoned, which is a continuation-in-part of Ser. No. 326,490, Jan. 24, 1973, abandoned.

[30] Foreign Application Priority Data

Jan. 31, 1972 Japan ..... 47-10555

[52] U.S. Cl. ..... 148/12 F; 148/12.3

[51] Int. Cl.[2] ..... C21D 1/78; C21D 9/46

[58] Field of Search ..... 148/12 F, 12.3

[56] References Cited

UNITED STATES PATENTS

| | | | |
|---|---|---|---|
| 3,328,211 | 6/1967 | Nakamura et al. | 148/12 |
| 3,671,334 | 6/1972 | Bucher et al. | 148/12.3 |
| 3,765,874 | 10/1973 | Elias et al. | 148/36 |
| 3,826,692 | 7/1974 | Kinoshita et al. | 148/12 C |
| 3,827,924 | 8/1974 | Takechi et al. | 148/12 F |
| 3,885,997 | 5/1975 | Bucher et al. | 148/12.3 |

*Primary Examiner*—W. Stallard
*Attorney, Agent, or Firm*—Toren, McGeady and Stanger

[57] ABSTRACT

A method for producing a high-strength cold rolled steel sheet or strip is disclosed. Steel comprising 0.05 to 0.15% of C;
0.02 to 0.30% of Si;
0.10 to 1.5% of Mn;
0.02 to 0.07% of Al; and
a total of 0.02 to 0.15% of at least one of Nb, V, Ti and Zr;
with the remainder being iron and unavoidable impurities, is hot rolled whereafter the hot rolled steel sheet or strip is coiled at a temperature of not more than 750°C. The coiled sheet or strip is then cold rolled whereafter the cold rolled steel sheet or strip is subjected to annealing at a temperature between 670°C and 900°C for 20 seconds to 10 minutes.

6 Claims, 2 Drawing Figures

METHOD FOR PRODUCING HIGH-STRENGTH COLD ROLLED STEEL SHEET

CROSS-REFERENCE TO PRIOR APPLICATIONS

Figure 1:
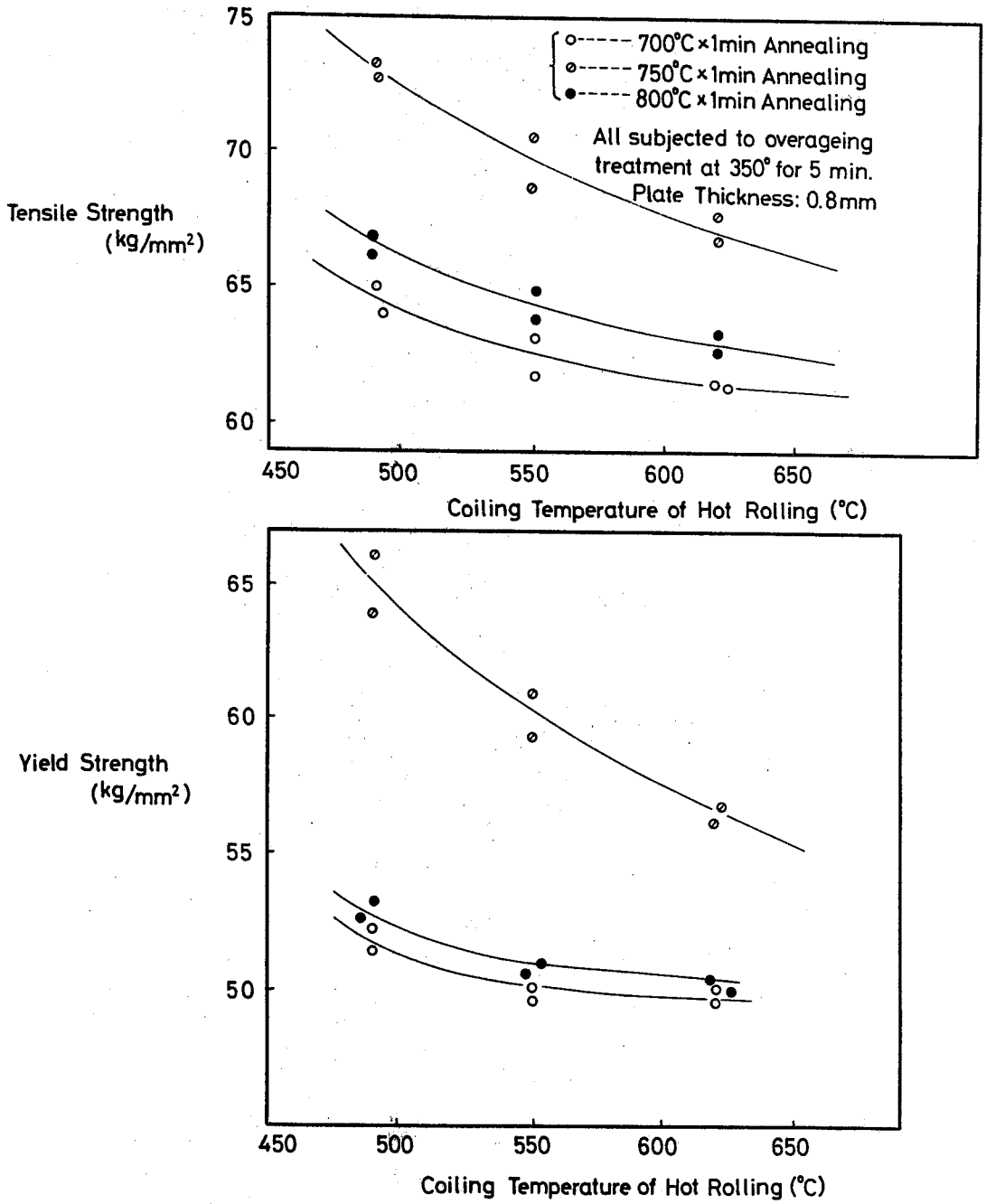

This is a continuation-in-part of U.S. Pat. application Ser. No. 432,205 filed Jan. 10, 1974, and now abandoned, which in turn is a continuation-in-part of U.S. Pat. application Ser. No. 326,490, filed on Jan. 24, 1973, now abandoned.

SUMMARY OF THE INVENTION

The present invention relates to a method for producing high-strength cold rolled steel sheet, in which low-carbon steel containing a total of 0.02 to 0.15% of one or more of Nb, V, Ti and Zr is hot rolled in such a manner that the coiling temperature of the hot rolled steel sheet (strip) is not more than 750°C, preferably not more than 550°C, and the hot rolled steel sheet is then cold rolled and subjected to a continuous annealing treatment.

In the development of industrial techniques and arts, press-formed steel sheet articles or thin-gauge structural steel sheets have been required to be structurally safe and reliable and to have high strength and good workability from the point of weight reduction.

The present invention relates to a method for producing materials which satisfy the above requirements.

It has previously been proposed to produce high-strength hot rolled steel sheets containing niobium by cold rolling and annealing. For example, in the Japanese Journal "Tetsu to Hagane" (Iron and Steel), No. 8, 1968, pages 102 to 114, entitled "Effects of Nb on Cold Working-Annealing Process of Low-Carbon Steel" it is disclosed that, when Al-Si-killed hot rolled steel sheet containing 0.03 to 0.06 wt. % of Nb is cold rolled and subjected to an ordinary box annealing, a high-strength cold rolled steel sheet having tensile strength of 60 kg/mm² as annealed can be obtained.

However, when a high-strength cold rolled steel sheet as above is produced by application of box annealing, the following defects and difficulties are encountered.

Due to the characteristics of box annealing, it is unavoidable that substantial temperature differences are caused by the position of the coil.

On the other hand, the strength of the above steel grade as cold rolled and annealed is largely influenced by the annealing temperature, and it is difficult to obtain steel sheets having a uniform strength along the length of the coil.

This is due to the fact that the strength of the material when box annealed is maintained by the hardening effect of Nb precipitates which occurred during the hot rolling, and generally such Nb precipitates grow coarse during box annealing above the $A_1$ transformation point, and the strength becomes lower than that of the hot rolled steel sheet. On the other hand, when the box annealing is done below about 670°C, recrystallization takes place with difficulty even by a longtime annealing and it is unavoidable that the ductility is remarkably lowered. For the above reason the proper range of the annealing temperature for obtaining the same level of strength as that of hot rolled steel sheets is very narrow and it is difficult to obtain a steel strip having uniform strength along the whole length of the coil.

Therefore, it is one of the objects of the present invention to overcome the above defects and difficulties encountered in box annealing and to produce by economical continuous annealing a high-strength cold rolled steel sheet having higher strength than that of the hot rolled steel sheet and better balanced yield point-total elongation than that of box annealed materials.

The steel composition necessary for attaining the object of the present invention comprises 0.05 to 0.15% of carbon, 0.002 to 0.30% of Si, 0.10 to 1.5% of Mn, 0.02 to 0.08% of Al, at least one of Nb, V, Ti and Zr in a total amount of 0.02 to 0.15%, the remainder being iron and unavoidable impurities. If the total addition of one or more of Nb, V, Ti and Zr is less than 0.02%, the desired results of the present invention cannot be obtained. On the other hand, if the total amount exceeds 0.15%, the production cost increases and the precipitates become coarse and the desired strength cannot be obtained.

Al is necessary for preventing segregation of elements such as Nb, V, Ti and Zr and for making the steel non-ageing, and less than 0.02 of Al is not enough for the above effects.

For applications where more than 70 kg/mm² of tensile strength and more than 40 kg/mm² of yield point are not required, it is not necessary to add Si. It is sufficient if Mn is present in such an amount as to prevent hot embrittlement. The lower limit for Mn is thus 0.1%.

In the course of continuously hot rolling the above steel composition, the present inventors discovered that the coiling temperature of the hot rolled steel strip affects the strength of the steel after continuous annealing. Thus, lower coiling temperature gives higher strength after the continuous annealing, and a coiling temperature below 750°C, preferably 550°C, is particularly effective.

In the present invention, the steel is hot rolled as above and cold rolled in an ordinary way and then subjected to continuous annealing.

The present invention shall be described in more detail by referring to the attached drawing.

FIG. 1 shows examples of yield point and tensile strength when steel strips coiled at different coiling temperatures are subjected to continuous annealing with various holding temperatures for annealing. The strength of these continuously annealed materials becomes largest when the holding temperature is 750°C, and when the coiling temperature is 490°C, the difference of tensile strength due to the holding temperature being about 10 kg/mm². Thus, the effect of the continuous annealing holding temperature on the strength is large, and a maximum strength is obtained around 750°C and this tendency is remarkable when the coiling temperature is low. This point is the first feature of the present invention.

It has also been discovered that an appropriate combination of the coiling temperature and the continuous annealing temperature produces tensile strength as annealed higher than that of the hot rolled material. Regarding the tendency that the strength after continuous annealing varies depending on the combination of the coiling temperature and the continuous annealing holding temperature, it is generally recognized that the strength level varies depending on the type and amount of strengthening elements such as Nb, V, Ti and Zr when these elements are present.

The increase of strength by the continuous annealing is considered to be due to the fact that the solid dissolved elements, such as Nb, V, Ti and Zr, which have not completely precipitated during the hot rolling, remain as partial precipitates during the continuous annealing. If the holding time of the continuous annealing is excessively long, the precipitates of the above elements become coarse above the $A_1$ transformation temperature, thus lowering the strength as in case of box annealing and causing economical disadvantage. Thus the holding time is preferably not more than 10 minutes. On the other hand, if the holding time is too short, recrystallization cannot take place and ductility is remarkably lowered. Thus the holding time should be not less than 20 seconds. A preferable range is 20 seconds to 3 minutes. The lower limit of the holding temperature is 670°C for completion of recrystallization, and its upper limit is 900°C in view of the transformation into the austenite as well as economy of the furnace. A preferable range is 725° to 800°C. Then the cold rolled steel sheet or strip which has been subjected to the short-time continuous annealing as above is rapidly cooled so that much carbon in solid solution remains in the steel, particularly when the coiling temperature is relatively low, to wit, not higher than about 550°C. Material deterioration, commonly called quench ageing, and lowering ductility is thus caused. In order to avoid this problem, it is desirable that an an overageing treatment for one to ten minutes, preferably 2 to 5 minutes at a between 300°C and 400°C, preferably 300° and 350°C, is conducted during the cooling step after the continuous annealing to accelerate the carbide precipitation, thereby avoiding the hardening effects peculiar to continuously annealed materials.

In this context it should be observed that the carbides and nitrides of Nb, V, Ti, etc. do not precipitate completely with a low temperature coiling at 550°C or lower temperature so that it is necessary to precipitate them completely by the overageing in the continuous annealing step, and thus the overageing treatment is then important.

By contrast, in case of a high temperature coiling between 550° and 750°C, the carbides and nitrides of Nb, V, Ti, etc. are precipitated completely so that the overageing treatment is not necessary in the continuous annealing step.

The material properties, particularly the balance between yield point and total elongation of the high-strength cold rolled steel sheet produced in the above manner are found to be better than those obtained by box annealing. This is the second feature of the present invention. The relation between the yield point and the total elongation in case when the steels having various chemical compositions within the scope of the present invention are produced by the method of the present invention is shown in FIG. 2 in comparison with that of the same materials but produced by box annealing.

Figure 2:
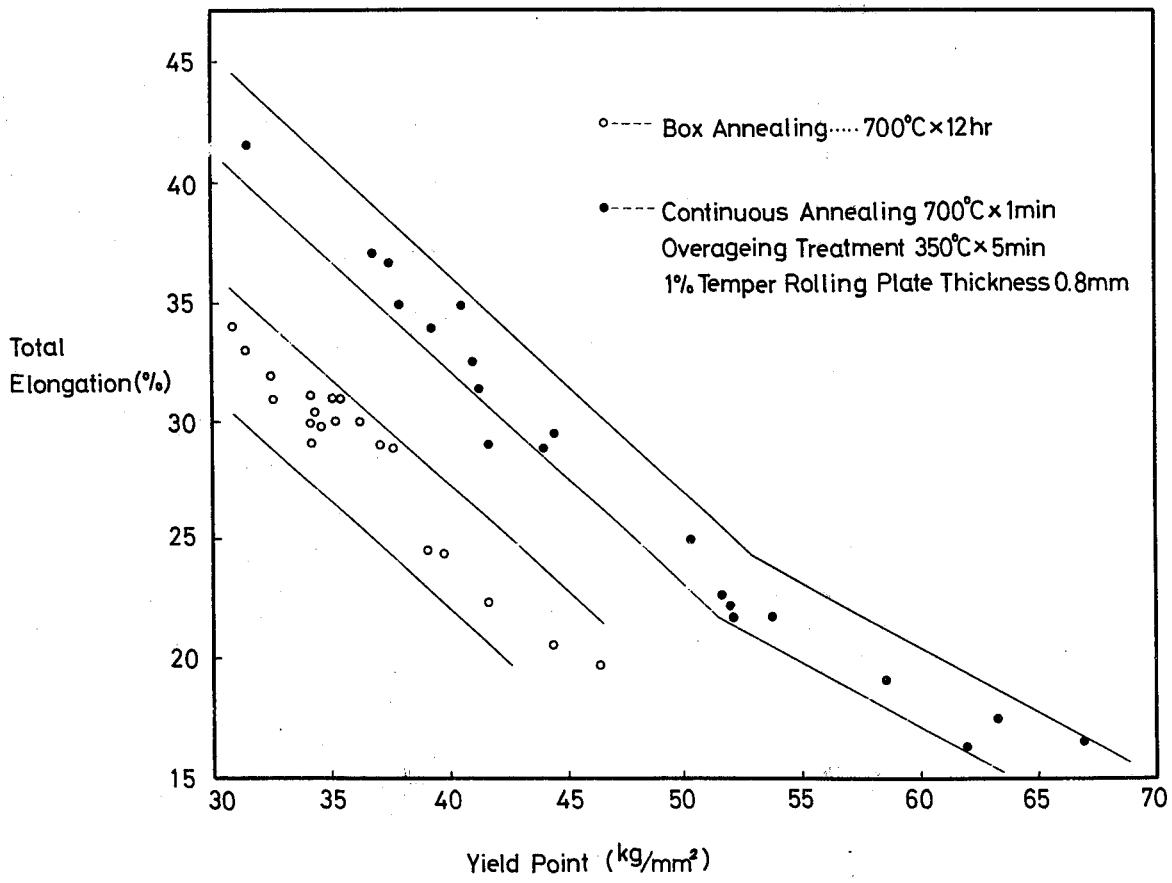

It is understood from FIG. 2 that the total elongation of the steel sheet produced by the inventive method is larger than that of the box annealed material having the same level of yield point. It is clear that this produces very remarkable advantages in the forming works of a high-strength cold rolled steel sheet.

Also according to the present invention, it is possible to control very strictly the annealing temperature along the whole length of the coil so that non-uniformity of strength and ductility due to the temperature difference encountered in box annealing can be avoided.

The present invention will be more clearly understood from the following examples:

EXAMPLE I

Table 1

| C | Si | Mn | P | S | Nb | V | Al | N |
|---|---|---|---|---|---|---|---|---|
| 0.12 | 0.25 | 1.33 | 0.013 | 0.007 | 0.05 | 0.03 | 0.026 | 0.0042 |

A steel heat having the composition shown in Table 1 was tapped and continuously hot rolled. In the hot rolling step, the steel was hot rolled to a thickness of 3.2 mm and coiled at a coiling temperature of 490°C. The thus obtained hot rolled steel strip was cold rolled to a thickness of 0.8 mm by an ordinary method, and thereafter subjected to a continuous annealing at 700°C for one minute and at 750°C for one minute and successively subjected to an overageing treatment at 350°C for five minutes. The results are shown in Table 2 in comparison with those of the box annealing.

Table 2

| Heat Treatment | Y.P. (kg/mm²) | T.S. (kg/mm²) | Total Elongation (%) |
|---|---|---|---|
| A 750°C × 1 min. Cont. Annealing + 350°C × 5 min. Overageing | 65.0 | 74 | 16.5 |
| B 700°C × 1 min. Cont. Annealing + 350°C × 5 min. Overageing | 52.0 | 64.5 | 22.0 |
| C 750°C × 8 hr. Box Annealing | 40.8 | 48.2 | 25.3 |
| (All were 1% temper rolled; thickness: 0.8 mm) | | | |
| D Hot Rolled Sheet | 58.0 (Thickness: 3.2 mm). | 65.5 | — |

EXAMPLE II

Table 3

| C | Si | Mn | P | S | Ti | Zr | Al | N |
|---|---|---|---|---|---|---|---|---|
| 0.08 | 0.05 | 0.50 | 0.015 | 0.010 | 0.08 | 0.03 | 0.032 | 0.0048 |

A steel heat having the composition shown in Table 3 was hot rolled to a thickness of 2.8 mm and coiled at 530°C. This hot rolled steel sheet was cold rolled to a thickness of 0.8 mm by an ordinary method and subjected to a continuous annealing at 700°C for one minute and at 750°C for one minute and then subjected to an overageing treatment at 350°C for five minutes. The results are shown in Table 4.

Table 4

| Heat Treatment | Y.P. (kg/mm²) | T.S. (kg/mm²) | Total Elongation (%) |
|---|---|---|---|
| A 750°C × 1 min. Cont. Annealing + 350°C × 5 min. Overageing | 53.8 | 66.3 | 21.8 |
| B 700°C × 1 min. Cont. Annealing + 350°C × 5 min. Overageing | 50.2 | 61.5 | 25.0 |
| (All were 1% temper rolled; thickness: 0.8 mm) | | | |

EXAMPLE III

Table 5

| C | Si | Mn | P | S | Ti | Zr | Al | N | F |
|---|---|---|---|---|---|---|---|---|---|

Table 5-continued

| | | | | | | | | | |
|---|---|---|---|---|---|---|---|---|---|
| 0.09 | 0.27 | 1.05 | 0.012 | 0.008 | 0.12 | 0.02 | 0.016 | 0.0056 | balance |

A steel heat having the composition shown in Table 5 was tapped, hot rolled into a plate thickness of 3.2 mm and coiled at 620°C. The thus obtained hot rolled plate was cold rolled into a thickness of 0.8 mm and subjected to continuous annealing at 750°C for one minute. The results are shown in Table 6 in comparison with those obtained by box annealing.

Table 6

| | Heat Treatment | Y.P. | T.S. | Total Elongation (%) |
|---|---|---|---|---|
| Inventive A | 750°C for 1 min. Continuous Annealing | 61.5 | 67.5 | 18.5 |
| Comparison B | 750°C for 8 hours Box Annealing | 40.7 | 53.0 | 26.2 |

(1% temper rolling, 0.8 mm thickness).

As understood from the above descriptions, the strength of the cold rolled steel sheet produced according to the present invention can exceed the strength of the starting hot rolled steel sheet if the heat treating conditions are appropriate combined with the continuous annealing conditions. This has never been attained or predicted by the conventional arts. Further, the yield point - total elongation balance of the cold rolled steel sheet produced by the present inventive method is better than that of the steel sheet produced by box annealing. This means that the field of forming work, to which the high-strength cold rolled steel sheet can be applied, is wider.

Further, it is possible to obtain a steel sheet having very uniform strength and ductility along the whole length of the coil by the present inventive method, and the annealing time in the present invention is much shorter than that of the box annealing and remarkable economical advantages are obtained.

What is claimed is:

1. A method of producing a high-strength cold rolled steel sheet or strip which comprises:

hot rolling steel comprising 0.05 to 0.05% of C;

0.02 to 0.30% of Si;

0.10 to 1.5% of Mn;

0.02 to 0.07% of Al; and a total of 0.02 to 0.15% of at least one metal selected from the group consisting of Nb, V, Ti, and Zr;

with the remainder being iron and unavoidable impurities;

coiling the hot rolled steel sheet or strip at a temperature not exceeding 750°C.

cold rolling the hot rolled steel sheet or strip;

subjecting the cold rolled steel sheet or strip to annealing at a temperature between about 670°C and 900°C for 20 seconds to 10 minutes.

2. A method according to claim 1, wherein the coiling is effected at a temperature between 550°C to 750°C.

3. A method according to claim 1 in which the annealing is conducted at a temperature between 725° and 800°C for 20 seconds to 3 minutes.

4. A method of producing a high-strength cold rolled steel sheet or strip which comprises:

hot rolling steel comprising 0.05 to 0.15% of C;

0.02 to 0.30% of Si;

0.10 to 1.5% of Mn;

0.02 to 0.07% of Al; and a total of 0.02 to 0.15% of at least one metal selected from the group consisting of Nb, V, Ti, and Zr;

with the remainder being iron and unavoidable impurities;

coiling the hot rolled steel sheet or strip at a temperature not exceeding 750°C;

cold rolling the hot rolled steel sheet or strip;

subjecting the cold rolled steel sheet or strip to annealing at a temperature between about 670°C and 900°C for 20 seconds to 10 minutes; and then subjecting the sheet to a carbide precipitation treatment at a temperature between 300° and 400°C.

5. A method according to claim 4, in which the coiling temperature is not more than 550°C.

6. A method according to claim 4, in which the carbide precipitation treatment is effected at a temperature of between 300° and 350°C for 2 to 5 minutes.

* * * * *